United States Patent [19]

Shimizu et al.

[11] 4,317,648

[45] Mar. 2, 1982

[54] APEX SEAL FOR ROTARY PISTON ENGINES WITH SEPARATE SEALING AND SUPPORT PIECES

[75] Inventors: Kazuma Shimizu; Haruhiko Satow, both of Hiroshima, Japan

[73] Assignee: Toyo Kogyo Co., Ltd., Hiroshima, Japan

[21] Appl. No.: 93,435

[22] Filed: Nov. 13, 1979

[30] Foreign Application Priority Data

Nov. 13, 1978 [JP] Japan ..... 53/156529[U]
Jan. 22, 1979 [JP] Japan ..... 54/6740[U]
Jan. 22, 1979 [JP] Japan ..... 54/6741[U]

[51] Int. Cl.[3] ..... F01C 19/04; F01C 19/08
[52] U.S. Cl. ..... 418/120; 418/122
[58] Field of Search ..... 418/120–123, 418/142, 124

[56] References Cited

U.S. PATENT DOCUMENTS 3,120,815 2/1964 Froede ..... 418/123
3,176,909 4/1965 Maurhoff ..... 418/121
3,301,231 1/1967 Tado ..... 418/121
3,685,922 8/1972 Lamm ..... 418/121
3,890,067 6/1975 Rao et al. ..... 418/121

FOREIGN PATENT DOCUMENTS 48-3534 1/1973 Japan .
53-7504 1/1978 Japan ..... 418/121

*Primary Examiner*—John J. Vrablik
*Attorney, Agent, or Firm*—Fleit & Jacobson

[57] ABSTRACT

An apex seal for rotary piston engines which comprises an elongated sealing piece and an elongated support piece which are superposed throughout their lengths. A side piece is provided at one end of the superposed pieces and has an inclined inward surface which is engaged with a correspondingly inclined end surface of the sealing piece but spaced from a correspondingly inclined end surface of the support piece. A spring is provided for urging the support and side pieces toward the inner wall of the rotor housing.

7 Claims, 9 Drawing Figures

APEX SEAL FOR ROTARY PISTON ENGINES WITH SEPARATE SEALING AND SUPPORT PIECES

The present invention relates to rotary piston engines and more particularly to apex seal means for rotary piston engines.

Conventionally, the apex seal of rotary piston engines comprises an elongated main sealing piece having a longitudinally extending sealing surface and one or two side pieces which are adapted to be engaged with end portions of the main sealing piece through slanted cam surfaces. The pieces are received in a seal groove formed in each apex portion of the rotor and urged by springs radially outwardly of the rotor so that the main sealing piece is maintained in engagement at the sealing surface with the trochoidal inner wall of the rotor housing and the side pieces are forced axially outwardly under the action of the slanted cam surfaces into engagement with the inner surfaces of the side housings. An example of such apex seal is disclosed by Japanese utility model publication 48-3534 published on Jan. 29, 1973.

In this type of apex seal, it is supported to provide a primary sealing function by the sealing surface of the main sealing piece which is in engagement with the inner wall surface of the rotor housing, as well as a secondary sealing function by forcing the main sealing piece into engagement with a side wall of the sealing groove under the gas pressure in the working chamber. However, since there are abrupt changes in the gas pressure, the main sealing piece is often detached from the side wall of the sealing groove so that there may be produced gas leakage through the clearance thus formed between the main sealing piece and the sealing groove.

In order to solve the above problem, the U.S. Pat. No. 3,120,815 issued on Feb. 11, 1964 to Waiter G. Froede proposes to provide an apex seal including an elongated sealing piece which is formed at radially inward end that is facing to the bottom of the sealing groove with a sidewardly inclined surface. A spring or an insert member having a corresponding inclined surface is forced into engagement with the sealing piece so that the sealing piece is sidewardly forced under the cam action of the mutually engaging inclined surfaces into engagement with the side wall of the sealing groove.

Even with the proposed structures of the apex seal, satisfactory results cannot be obtained due mainly to the fact that the sealing piece is relatively rigid in the radial direction of the rotor. In operation of rotary piston engines, there is a tendency that the middle portion of the inner wall of the rotor housing is radially outwardly deformed due to thermal expansion to provide a concave configuration so that such rigid sealing piece cannot be engaged with the rotor housing inner wall with an even pressure throughout its length. Thus, the inner wall of the rotor housing may be subjected to local wear.

It is therefore an object of the present invention to provide a rotary piston engine including a casing which comprises a rotor housing having an inner wall of trochoidal configuration and a pair of side housings secured to the opposite sides of the rotor housing to define a rotor cavity in the casing, a rotor of substantially polygonal configuration disposed in said rotor cavity for rotation with apex portions in sliding engagement with the inner wall of the rotor housing, apex seal means provided in each apex portion of the rotor and comprising a sealing groove formed in the rotor at the apex portion to extend in axial direction of the rotor, an elongated sealing piece having flexibility in radial direction of the rotor and an elongated support piece, said sealing and support pieces being disposed in said sealing groove in a superposed relationship substantially throughout their lengths with said sealing piece faced to the inner wall of the rotor housing, spring means disposed between the support piece and the sealing groove to bias the sealing and support pieces toward the inner wall of the rotor housing. The apex seal means may further include a side piece at one or each end portion as in conventional apex seals. Since the sealing piece has a flexibility in radial direction of the rotor, it can engage with the inner wall of the rotor uniformly throughout its length even when a thermal deformation is produced in the inner wall of the rotor housing.

In a preferable mode of the present invention, the sealing and support pieces are superposed through sidewardly inclined mating surfaces so that a wedging or cam action is produced to force the sealing piece toward one side and the support piece toward the other side into contact with respective side walls of the sealing groove. The mating surfaces may not however be inclined as described above because, for the purpose of the present invention, the functions of the support piece are primarily to prevent gas leakage around the back side of the sealing piece by providing a detour passage around the support piece and secondary to suppress possible vibrations of the sealing piece. Where the apex seal is provided with a side piece which has an inclined inward surface adapted to be engaged with a correspondingly inclined surface at an end of the sealing piece, the support piece may also have a correspondingly inclined surface at the adjacent end. In this instance, in order to ensure a positive contact between the sealing and side pieces, the inclined end surface of the support piece should be spaced from the side piece. The gap between the support and side pieces may then be filled with an inset of non-rigid material such as fluorinated resin, zinc, tin or copper. Further, any clearance in corner seals may also be filled with a non-rigid material.

The above and other objects and features of the present invention will become apparent from the following descriptions of preferred embodiments taking reference to the accompanying drawings, in which.

Figure 1:
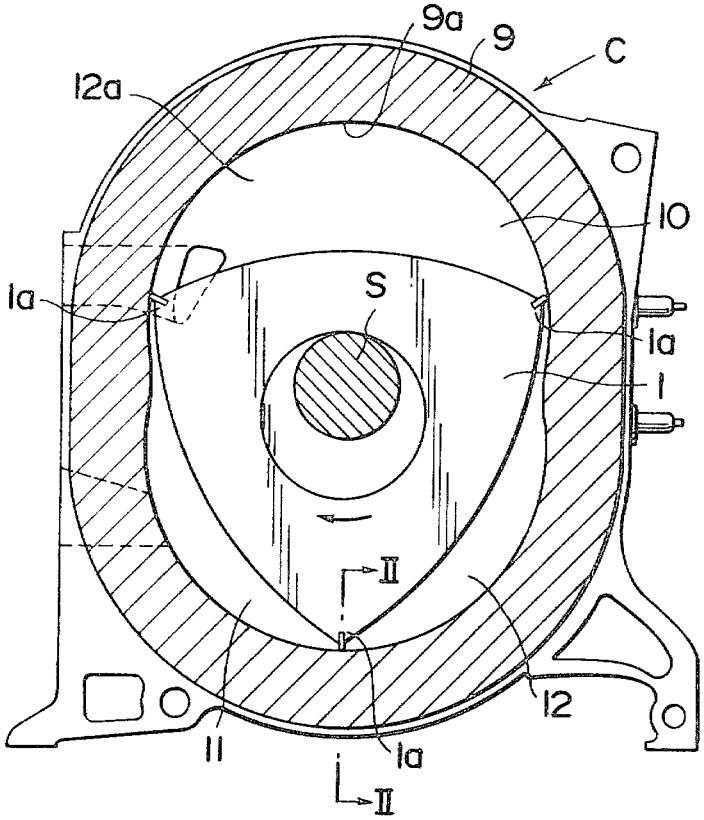
FIG. 1 is a sectional view of a rotary piston engine to which the present invention can be applied.

Referring now to the drawings, particularly to FIG. 1, the rotary piston engine shown therein includes a casing C comprised of a rotor housing 9 having an inner wall 9*a* of trochoidal configuration and a pair of side housings 10 having inner surfaces 10*a* and secured to the opposite sides of the rotor housing 9. In the casing C, there is disposed a rotor 1 of substantially triangular configuration which is carried by an eccentric shaft S for rotation with apex portions 1*a* in sliding contact with the inner wall 9*a* of the rotor housing 9 to define working chambers 11, 12 and 12*a*.

Figure 2:
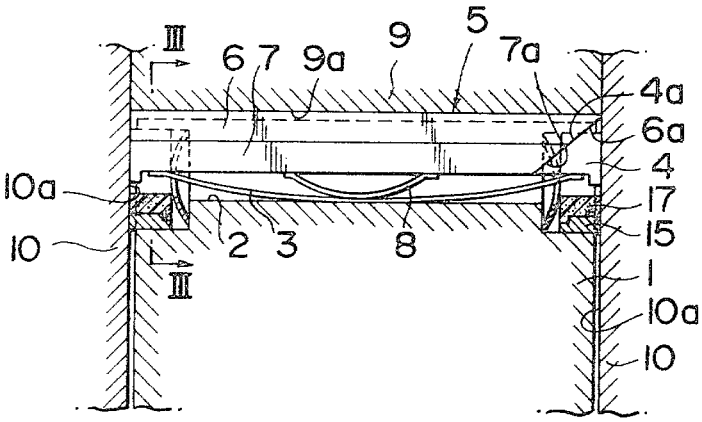
FIG. 2 is a sectional view taken substantially along the line II—II in FIG. 1.
Figure 4:
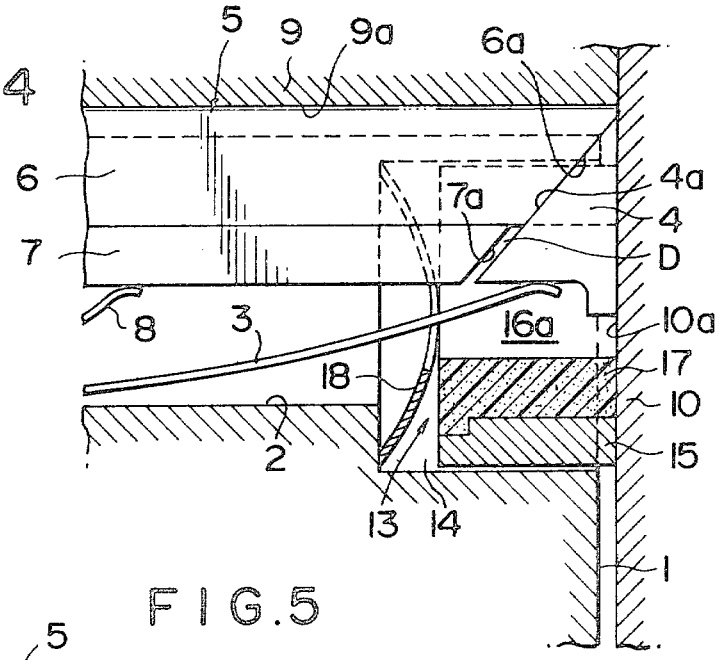
FIG. 4 is an enlarged sectional view showing specifically showing corner seal structures employed in the arrangement of FIG. 2.

Referring now to FIG. 2, in each apex portion 1*a*, the rotor 1 is formed with an axially extending sealing groove 2 for receiving an apex seal 5 therein. The apex 5 comprises a side piece 4, an elongated sealing piece 6 and an elongated support piece 7. The sealing and support pieces 6 and 7 are disposed along the sealing groove 2 with a superposed relationship. The side piece 4 has an inclined inward surface 4*a* and the sealing and support pieces 6 and 7 have correspondingly inclined end surfaces 6*a* and 7*a*, respectively. A main leaf spring 3 is provided in the groove 2 with its opposite ends in engagement respectively with the support piece 7 and the side piece 4. Further, an auxiliary spring 8 is provided between the main spring 3 and the support piece 7. Thus, the pieces 4, 6 and 7 are resiliently forced toward the inner wall 9*a* of the rotor housing 9. Since the side piece 4 is in engagement at the inward face 4*a* with the end surface 6*a* of the sealing piece 6, the wedging action produced therebetween functions to force the side piece 4 into engagement with the inner wall 10*a* of one of the side housings 10 and the sealing piece 6 toward the inner wall 10*a* of the other side housing 10. In order to ensure a positive engagement between the side and sealing pieces 4 and 6, it is preferable to have the end surface 7*a* of the support piece 7 spaced apart from the inward surface 4*a* of the side piece 4 to provide a gap D as shown in FIG. 4. In order to suppress gas leakage through the gap D and prevent the support piece from being inclined in the axial direction, the gap D should preferably be less than 200 microns.

In the illustrated apex seal, the sealing piece 6 is of a relatively small dimension in radial direction of the rotor 1. In other words, the sealing piece 6 is of a relatively small width so that it possesses a certain flexibility in widthwise direction. Therefore, the sealing piece 6 can follow the configuration of the inner wall 9*a* of the side housing to thereby maintain a substantially uniform contact throughout its length with the inner wall 9*a*. The support piece 7 functions to prevent gas leakage around the back side of the seal piece 6 and provide a detour path for gas leakage. Thus, it is possible to suppress gas leakage around the back side of the apex seal.

Figure 3:
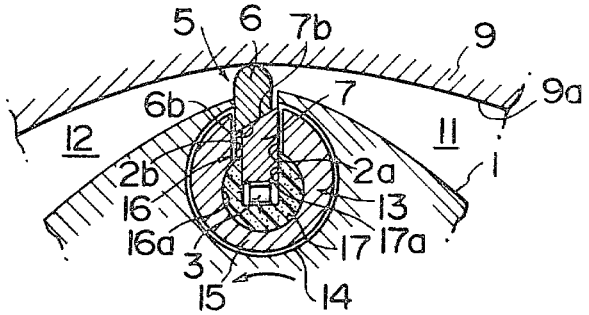
FIG. 3 is a sectional view taken substantially along the line III—III in FIG. 2.

In order to provide a further gas tightness, it is preferable to form the sealing piece 6 with an inclined back surface 6*b* and the support piece 7 with a correspondingly inclined surface 7*b* which is adapted to be engaged with the back surface 6*b*, as shown in FIG. 3. In this arrangement, a sideward force is produced between the pieces 6 and 7 so that the sealing piece 6 is forced into engagement with one of the side walls 2*a* and 2*b* of the sealing groove 2 and the support piece 7 with the other side wall. Thus, it is possible to prevent or substantially decrease gas leakage through the sealing groove 2.

Figure 5:
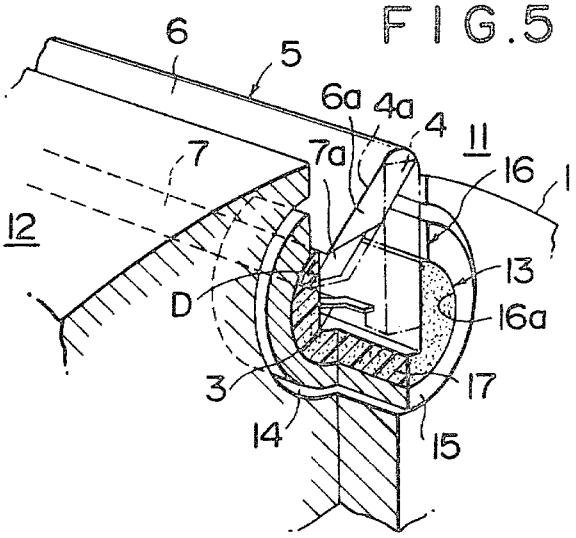
FIG. 5 is a partially cut-away perspective view of the corner seal structures shown in FIG. 4.

At the opposite ends of the sealing groove 2, the rotor 1 is formed with corner seal recesses 14 for receiving corner seals 13. The corner seal 13 includes a ring-shaped corner seal piece 15 adapted to be fitted to the recess 14. The piece 15 has a radial slit 16 and a circular opening 16*a*, the latter being filled with an insert 17 of a non-rigid material. The insert 17 has a groove 17*a* in which the bottom portion of the support piece 7 is received as shown in FIG. 3. Similarly, as shown in FIGS. 4 and 5, the bottom portion of the side piece 4 is also received in the groove 17*a* of the insert 17. A leaf spring 18 is provided in the recess 14 for urging the corner seal piece 15 toward the inner wall 10*a* of the side housing 10.

The insert 17 of non-rigid material in the corner seal piece 15 serves to prevent gas leakage through the corner seal 13. Since the gap D between the end surface 7*a* of the support piece 7 and the inward surface 4*a* of the side piece 4 is located in the corner seal 13 as shown in FIGS. 4 and 5, it is possible to prevent gas leakage through the gap D by the insert 17. The insert 17 may be made from a suitable resilient, heat-resistant and wear-resistant material, for example, a heat resistant rubber such as a fluororubber and a silicon rubber or a composite material containing carbon particles bound by tetrafluoroethylene.

Figure 6:
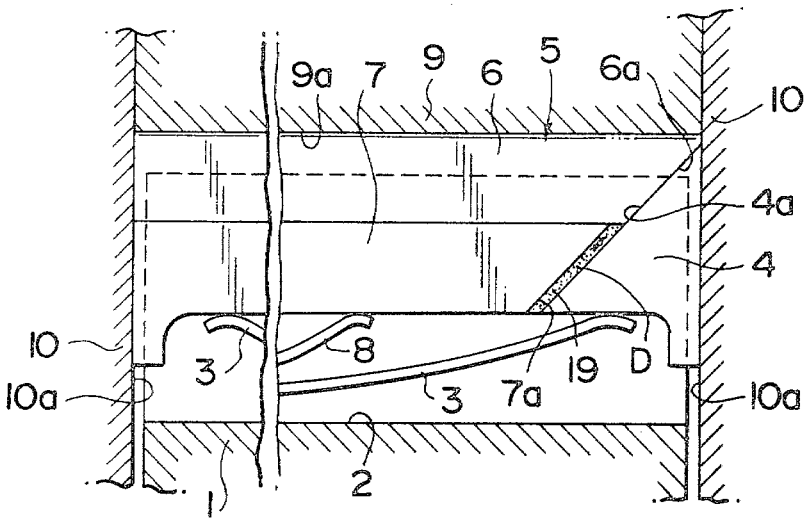
FIG. 6 is a sectional view similar to FIG. 2 but showing a modification.

Referring now to FIG. 6, it will be noted that the inclined end surface 7*a* of the support piece 7 is spaced apart from the inclined inward surface 4*a* to provide a gap D as in the previous embodiment. In this embodiment, however, the gap D is filled with an insert 19 of a non-rigid material such as a fluorine resin, zinc, tin or copper. The insert 19 prevents gas leakage through the gap D.

Figure 7:
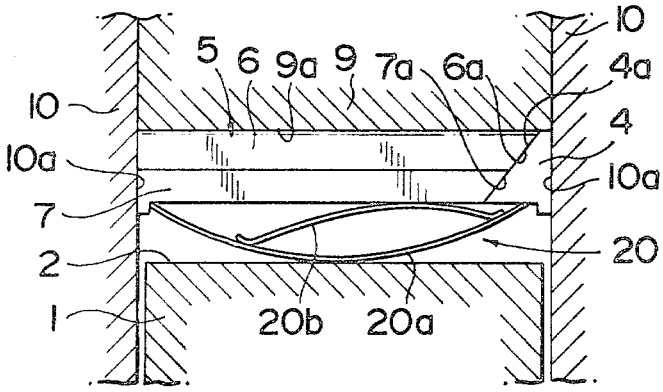
FIGS. 7 through 9 are sectional views showing different embodiments having modified biasing springs.
Figure 8:
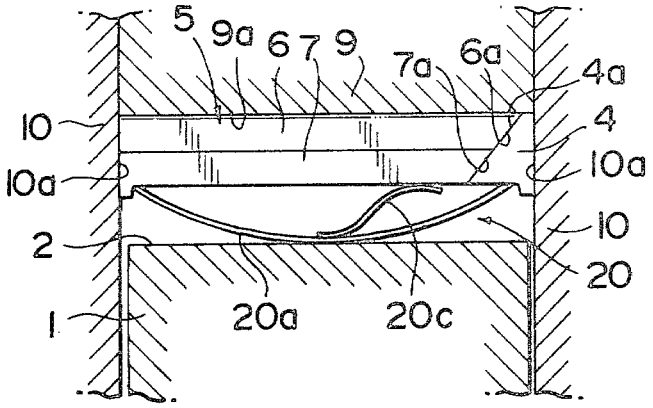

Referring now to FIG. 7, there is shown another embodiment in which a spring 20 of modified form is used. In this embodiment, the spring 20 comprises a base portion 20*a* of an arcuated configuration which is engaged at its opposite ends respectively with the support piece 7 and the side piece 4. The spring 20 further includes an auxiliary portion 20*b* which is of an arcuated configuration and secured at one end with the base portion 20*a*. The other end of the auxiliary portion 20*b* is slidably engaged with the base portion 20*a*. The auxiliary portion 20*b* is convexed toward the support piece 7 and engaged therewith at a portion apart from the portion where the base portion is engaged therewith. FIG. 8 shows another embodiment in which the spring 20 includes a base portion 20*a* and an auxiliary portion 20*c* which is secured at one end to the base portion 20*a* and slidably engaged at the other end with the support piece 7.

Figure 9:
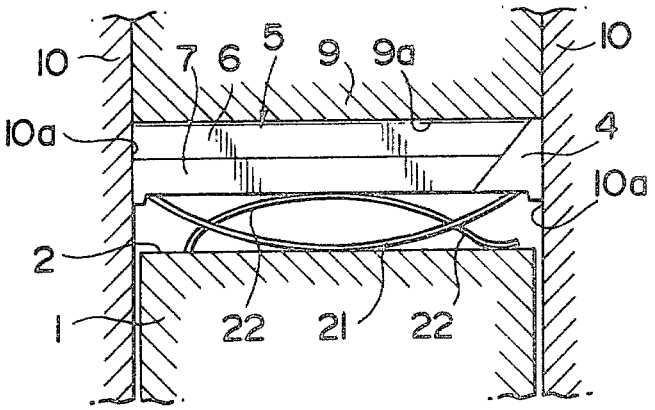

Referring to FIG. 9, there is shown another embodiment in which two springs 21 and 22 are used for biasing the apex seal toward the inner wall 9*a* of the rotor housing 9. The spring 21 is similar to the base portion 20*a* of the embodiments shown in FIGS. 7 and 8. The other spring 22 is of an arcuated configuration and has one end secured to the bottom of the sealing groove 2, the other end of the spring 22 being slidably engaged with the bottom of the sealing groove 2. The spring 22 is convexed toward the support piece 7 and engaged therewith at a portion apart from the portion where the spring 21 engages with the support piece 7.

The invention has thus been shown and described with reference to specific embodiments, however, it should be noted that the invention is in no way limited to the details of the illustrated structures but changes and modifications may be made without departing from the scope of the appended claims.

We claim:

1. A rotary piston engine including a casing which comprises a rotor housing having an inner wall of trochoidal configuration and a pair of side housings secured to the opposite sides of the rotor housing to define a rotor cavity in the casing, a rotor of substantially polygonal configuration disposed in said rotor cavity for rotation with apex portions in sliding engagement with the inner wall of the rotor housing, apex seal means comprising an elongated sealing piece, an elongated support piece, and at least one side piece, said sealing piece being of a relatively small dimension with respect to the size of the rotor in a radial direction of the rotor in order to have flexibility in the radial direction of the rotor, said sealing and support pieces being disposed in a sealing groove formed in the apex portion of the rotor in a superposed relationship substantially throughout their lengths with said sealing piece faced to the inner wall of the rotor housing, said sealing and support pieces being independent of each other and freely slidable with respect to each other in the rotating direction of the rotor, said support piece being of a substantially rectangular cross-section having a diametrical height greater than a width thereof and being provided at a radially outward edge with a surface which is inclined radially inwardly as seen in direction of rotation of the rotor, said sealing piece being of a cross-section having a diametrical height greater than a width thereof and being provided at a radially inward edge with a surface which is inclined so as to correspond to the said inclined surface of the support piece, said inclined surfaces being spaced from a bottom surface of the support piece, said side piece being provided at least at one end of the sealing and support pieces and having an inclined axially inward surface, said sealing and support pieces having end surfaces which are inclined so as to correspond to the inward surface of the side piece, the end surface of the sealing piece being in engagement with the inward surface of the side piece, and the end surface of the support piece being spaced from the inward surface of the side piece to provide a slight gap therebetween, and spring means disposed between the support piece and the sealing groove to bias the sealing and support pieces toward the inner wall of the rotor housing.

2. A rotary piston engine in accordance with claim 1 in which said gap between the end surface of the support piece and the inward surface of the side piece is filled with a non-rigid material.

3. A rotary piston engine in accordance with claim 1 in which the gap between the support piece and the side piece is less than 200 microns.

4. A rotary piston engine in accordance with claim 1 in which said spring means includes a base element having opposite ends respectively engaged with the support and side pieces and an auxiliary element engaged with the support piece at a portion spaced apart from a portion where the base element is engaged with the support piece.

5. A rotary piston engine in accordance with claim 1 which further includes a corner seal including a corner seal piece surrounding at least partially the gap between the end surface of the support piece and the inward surface of the side piece, said corner seal piece further surrounding at least partially the sealing, side and support pieces with clearances therebetween.

6. A rotary piston engine in accordance with claim 5 in which said clearance between the corner seal and the sealing, side and support pieces is filled with a non-rigid material.

7. A rotary piston engine in accordance with claim 6 in which said gap between the end surface of the support piece and the inward surface of the side piece is filled with a non-rigid material.

* * * * *